US012343776B2

(12) United States Patent
Kreikemeier et al.

(10) Patent No.: US 12,343,776 B2
(45) Date of Patent: Jul. 1, 2025

(54) HOT-ROLLING STAND FOR A HOT-ROLLING MILL AND FOR PRODUCING A FLAT METAL PRODUCT, HOT-ROLLING MILL AND METHOD FOR OPERATING A HOT-ROLLING MILL

(71) Applicant: SMS group GmbH, Düsseldorf (DE)

(72) Inventors: Jens Kreikemeier, Lennestadt (DE); Gokhan Erarslan, Düsseldorf (DE); Stephan Fischer, Hilchenbach (DE); Joachim Hafer, Siegen (DE)

(73) Assignee: SMS group GmbH, Düsseldorf (DE)

( * ) Notice: Subject to any disclaimer, the term of this patent is extended or adjusted under 35 U.S.C. 154(b) by 464 days.

(21) Appl. No.: 17/784,354

(22) PCT Filed: Dec. 11, 2020

(86) PCT No.: PCT/EP2020/085853

§ 371 (c)(1),
(2) Date: Jun. 10, 2022

(87) PCT Pub. No.: WO2021/116460

PCT Pub. Date: Jun. 17, 2021

(65) Prior Publication Data

US 2023/0060110 A1 Feb. 23, 2023

(30) Foreign Application Priority Data

Dec. 11, 2019 (DE) ..... 10 2019 219 318.8
Feb. 13, 2020 (DE) ..... 10 2020 201 789.1
May 15, 2020 (DE) ..... 10 2020 206 174.2

(51) Int. Cl.
*B21B 13/00* (2006.01)
*B21B 31/08* (2006.01)
(Continued)

(52) U.S. Cl.
CPC ..... *B21B 13/001* (2013.01); *B21B 31/08* (2013.01); *B21B 31/203* (2013.01); *B21B 31/30* (2013.01);
(Continued)

(58) Field of Classification Search
CPC ..... B21B 13/001; B21B 31/203; B21B 31/30; B21B 31/32; B21B 31/16; B21B 31/20;
(Continued)

(56) References Cited

U.S. PATENT DOCUMENTS 3,245,672 A 4/1966 Loeck et al.
3,516,276 A * 6/1970 Bond ..... B21B 31/04 72/237
(Continued)

FOREIGN PATENT DOCUMENTS

CN 1195584 A 10/1998
CN 1978081 C 8/2008
(Continued)

OTHER PUBLICATIONS

Gokhan Erarslan, co-pending U.S. Appl. No. 17/784,302, national phase entry of international application PCT/EP2020/084376.
(Continued)

*Primary Examiner* — Teresa M Ekiert
(74) *Attorney, Agent, or Firm* — Smartpat PLC

(57) ABSTRACT

A hot-rolling stand (10) for a hot-rolling mill comprises an adjusting device (12), which is intended for receiving a pair of work rolls (17) and for positioning work rolls (18, 19; 20, 21) of the pair of work rolls (17) in relation to one another to define a roll gap. In order to create a hot-rolling stand (10) that can be adapted as flexibly as possible, the adjusting device (12) is designed to interchangeably accommodate, in
(Continued)

the pair of work rolls (17), different roll diameter ranges by means of mutually complementary work rolls (18, 19; 20, 21).

16 Claims, 4 Drawing Sheets

(51) Int. Cl.
*B21B 31/20* (2006.01)
*B21B 31/30* (2006.01)
*B21B 31/32* (2006.01)

(52) U.S. Cl.
CPC ..... *B21B 31/32* (2013.01); *B21B 2203/36* (2013.01); *B21B 2265/14* (2013.01); *B21B 2267/06* (2013.01)

(58) Field of Classification Search
CPC ..... B21B 31/22; B21B 31/08; B21B 2203/36; B21B 29/00; B21B 37/16; B21B 37/58; B21B 37/62; B21B 2269/04; B21B 2271/02; B21B 2267/06; B21B 38/10
USPC ..... 72/244; 700/148, 155
See application file for complete search history.

(56) References Cited

U.S. PATENT DOCUMENTS

| | | | | |
|---|---|---|---|---|
| 3,518,862 | A | 7/1970 | Laminage | |
| 3,559,432 | A * | 2/1971 | Rastelli | B21B 37/64 72/28.2 |
| 3,861,190 | A | 1/1975 | Maltby et al. | |
| 4,038,857 | A | 8/1977 | Eibe et al. | |
| 5,038,591 | A | 8/1991 | Tajima et al. | |
| 5,461,770 | A | 10/1995 | Kimura et al. | |
| 5,564,178 | A | 10/1996 | Takashima et al. | |
| 5,634,257 | A | 6/1997 | Kajiwara et al. | |
| 5,970,594 | A | 10/1999 | Borsi et al. | |
| 6,062,055 | A | 5/2000 | Bobig et al. | |
| 6,244,090 | B1 | 6/2001 | Viavant | |
| 8,011,418 | B2 | 9/2011 | Rosenthal et al. | |
| 2003/0167817 | A1 | 9/2003 | Seidel et al. | |
| 2006/0010952 | A1 | 1/2006 | Valence et al. | |
| 2006/0196243 | A1 | 9/2006 | Viavant | |
| 2009/0013745 | A1 | 1/2009 | Rackel | |
| 2010/0077824 | A1 | 4/2010 | Mittermayr | |
| 2010/0116380 | A1 | 5/2010 | Seidel et al. | |
| 2011/0154877 | A1 | 6/2011 | Breuer et al. | |
| 2011/0272116 | A1* | 11/2011 | Benedetti | B21B 1/46 164/424 |
| 2012/0073345 | A1 | 3/2012 | Diez et al. | |
| 2012/0160377 | A1 | 6/2012 | Seidel et al. | |
| 2015/0343524 | A1 | 12/2015 | Witschas et al. | |
| 2016/0107212 | A1 | 4/2016 | Calcoen et al. | |
| 2020/0061685 | A1 | 2/2020 | Seidel et al. | |
| 2022/0379360 | A1* | 12/2022 | Leflay | G01B 7/14 |

FOREIGN PATENT DOCUMENTS

| | | | |
|---|---|---|---|
| CN | 201172064 | | 12/2008 |
| CN | 101809173 | A | 8/2010 |
| CN | 202087591 | U | 12/2011 |
| CN | 103084402 | A | 5/2013 |
| CN | 103464463 | A | 12/2013 |
| CN | 101961728 | B | 3/2014 |
| CN | 102549173 | B | 7/2014 |
| CN | 102240674 | B | 12/2014 |
| CN | 101945715 | B | 1/2015 |
| CN | 204159642 | U | 2/2015 |
| CN | 204448821 | U | 7/2015 |
| CN | 205732274 | U | 11/2016 |
| CN | 105142811 | B | 1/2018 |
| CN | 107413856 | B | 2/2019 |
| DE | 3811875 | A1 | 4/1989 |
| DE | 3841980 | A1 | 6/1990 |
| DE | 19525657 | A1 | 1/1997 |
| DE | 10046426 | A1 | 3/2002 |
| DE | 69905332 | | 10/2003 |
| DE | 602004007631 | | 4/2008 |
| DE | 102008029581 | A1 | 1/2009 |
| DE | 102007048747 | A1 | 3/2009 |
| DE | 202011110779 | U1 | 5/2016 |
| DE | 102017200731 | A1 | 5/2018 |
| EP | 0143166 | A1 | 6/1985 |
| EP | 0698428 | A1 | 2/1996 |
| EP | 2943296 | A1 | 11/2015 |
| EP | 3003590 | | 4/2016 |
| EP | 3486001 | A1 | 5/2019 |
| GB | 8727417 | | 12/1987 |
| GB | 2198982 | A | 1/1991 |
| JP | S51107254 | A | 9/1976 |
| JP | S6117303 | U | 1/1986 |
| JP | S62275508 | A | 11/1987 |
| JP | S6313601 | A | 1/1988 |
| JP | S6313603 | A | 1/1988 |
| JP | S6434505 | A | 2/1989 |
| JP | H10286611 | A | 10/1998 |
| JP | 2002210506 | B | 4/2002 |
| JP | 2004298932 | B | 6/2005 |
| JP | 2005262279 | B | 4/2011 |
| JP | 2013501144 | A | 1/2013 |
| JP | 2016520004 | A | 7/2016 |
| RU | 2252829 | C2 | 5/2005 |
| WO | 2011015365 | A1 | 2/2011 |
| WO | 2012125498 | A2 | 9/2012 |
| WO | 2013042204 | A1 | 3/2013 |
| WO | 2017050493 | A1 | 3/2017 |
| WO | 2018086762 | A1 | 5/2018 |

OTHER PUBLICATIONS

Modernisation du Laminoir a Chaud de Shagang en Chine//Hot Strip Mill Modernization at Shagang, China, Authors: Jian L, et al, Publication data: Revue de metallurgie—Cahiers d'informations techniques,,Jul. 1, 2003, Source info: vol. 100, Nr: 7/08, pp. 713-727.

Murugabhoopathy, K., R. Satish, and R. Shanmuga Prakash. "Study on improving the rolling and its allied practices to achieve high productivity, quality, improved techno-economic factors and equipment reliability in hot rolling mill of salem steel plant." AIP Conference Proceedings. vol. 2128. No. 1. AIP Publishing LLC, 2019.

"Non-ferrous Plastic Processing of Metals", Yanhuanthus, p. 60, Metallurgical Industry Press, Jan. 1982, 1st Edition.

Kao Kao Kao, et al., pp. 204-205, Metallurgical Industry Press, Oct. 1995, 1st Edition.

The State Intellectual Property Office of People's Republic of China, Office Action in related application CN202080086181.8.

* cited by examiner

HOT-ROLLING STAND FOR A HOT-ROLLING MILL AND FOR PRODUCING A FLAT METAL PRODUCT, HOT-ROLLING MILL AND METHOD FOR OPERATING A HOT-ROLLING MILL

TECHNICAL FIELD

The disclosure relates to a hot-rolling stand for a hot-rolling mill and for producing a flat metal product, comprising an adjusting device, which is intended for receiving a pair of work rolls and for positioning work rolls of the pair of work rolls in relation to one another to define a roll gap. Furthermore, the invention relates to a hot-rolling mill and a method for operating a hot-rolling mill.

BACKGROUND

Rolling mills are used to form metallic starting products. In hot-rolling mills in particular, starting products are formed from a primary shape to an intermediate or final dimension in the hot state. For this purpose, the hot-rolling mills can be directly connected to a continuous casting line. Typically, a hot-rolling mill for a flat product has an equalizing or reheating furnace for heating and/or homogenizing the starting product to the desired forming temperature and other units. Depending on the end products to be produced, for example the material, the target dimension or the desired degree of deformation, such units are then combined in sequence in a line to form a rolling train. Typically, these are hot-rolling stands, transport sections, cooling equipment, separating equipment, heating equipment and/or surface treatment equipment. In a hot-rolling stand, the rolled material to be treated is formed by work rolls of a pair of work rolls, which is usually accommodated in a roll stand in combination with support rolls. Thereby, a roll diameter range of the work rolls is usually determined with regard to various operating parameters of the hot-rolling mill and also parameters to be achieved for the end product to be manufactured.

JP 56313601 A shows a roll stand that discloses a change of configuration from a quarto-type roll stand to a sexto-type roll stand to be able to roll a more comprehensive range of thicknesses. To change the configuration, both an intermediate set of rolls and a set of work rolls are inserted into the installation space of the set of work rolls, wherein the work rolls have a relatively small roll diameter.

SUMMARY

The disclosure is based on the object of realizing a hot-rolling stand for a hot-rolling mill, wherein the hot-rolling stand is to be adjustable as flexibly as possible to different finished products, process designs, dimensions, materials and/or quality requirements without having to include an additional/further set of rolls in the stand.

The object is achieved by the subject matter as in the independent claim(s). Each of the dependent claims sets forth advantageous further developments of the invention.

A hot-rolling stand comprises an adjusting device that is provided for accommodating a pair of work rolls and positioning work rolls of the pair of work rolls in relation to one another while defining a roll gap. Preferably, the adjusting device of the hot-rolling stand thereby comprises a roll stand in which the pair of work rolls is mounted and in which the work rolls of the pair of work rolls are positioned in relation to one another via further components of the adjusting device. The pair of work rolls consists in particular of two work rolls in the form of a lower work roll and an upper work roll, wherein, in the roll stand, each of the individual work rolls preferably is guided in an associated guide element in the mounted state. The respective guiding element is thereby in particular a respective chock, in which the respective work roll is rotatably mounted.

In particular, each of the work rolls of the pair of work rolls is in contact with at least one support roll in the mounted state, against which the individual work roll can be supported in the course of a rolling operation and the application of a corresponding forming force to the rolled material to be formed. These support rolls are also preferably each guided in an associated guide element, which is preferably also a chock.

The "adjusting device" of the hot-rolling stand in accordance with the invention is a device by means of which the work rolls of the pair of work rolls can be positioned in relation to one another, if necessary indirectly via intermediate support rolls, forming a desired roll gap. In addition to two roll stands, the adjusting device particularly preferably comprises further components that can include a wedge adjusting device of a lower work roll of the pair of work rolls and/or a hydraulic positioning device of an upper work roll of the pair of work rolls and/or in each case a work roll bending device of the lower and/or the upper work roll. Thereby, the wedge adjusting device, the hydraulic positioning device and the respective work roll bending device can each have further individual components if necessary.

The roll stand is designed as a hot-rolling stand for use in hot rolling, that is, for a rolling process of a rolled material at a temperature above the recrystallization temperature of a metal to be processed. A "roll gap" between the work rolls of the pair of work rolls refers to a distance between the work rolls.

The adjusting device is designed to interchangeably accommodate, in the pair of work rolls, different roll diameter ranges by means of mutually complementary work rolls. In other words, with the hot-rolling stand, the adjusting device is designed to accommodate work rolls of a pair of work rolls, wherein the work rolls can thereby be replaced in pairs while changing the roll diameter range. The work rolls mounted in the hot-rolling stand always correspond to one another with regard to the selected roll diameter range. The selectable (work) roll diameter ranges differ from one another in that the diameter deviation goes (significantly) beyond the usual roll grinding.

Such a design of a hot-rolling stand has the advantage that, due to the interchangeability in pairs of the work rolls of the pair of work rolls, the hot-rolling stand can be adjusted to the desired operating parameters. Thus, such adjustment can take place through the suitable selection of the roll diameter range with regard to a respective product to be manufactured, a respective process control, respective dimensions, respective materials and/or respective quality requirements, such that the spectrum of products that can be manufactured is increased. Such adjustment can be made more rapidly and easily without the need for additional rolls in the stand. With regard to the rolled material dimensions in a hot-rolling mill, the introduction of an additional set of rolls would lead to extensive further adjustments, for example to the inlet guides, the drive train, but also the adjusting device, which would have to be carried out during a maintenance shutdown, for example. Overall, the invention can be used to realize a flexibly adjustable hot-rolling stand, the application of which also makes it possible to realize a flexibly manageable hot-rolling mill by selecting a roll diameter range of the interchangeable work rolls with regard to the planned operating parameters.

This provides the possibility of accommodating different conditions and requirements during hot rolling. Thus, with decreasing roll diameter and otherwise identical rolling conditions (inlet and outlet thickness, width, material, inlet temperature, strip speed), the system load (rolling force, rolling moment), a heat flow from the rolled material into the respective work roll and also the energy consumption decrease due to the reduced forming work. On the other hand, the pressure angle is reduced as the roll diameter increases, while the inlet thickness and the absolute reduction remain constant. The smaller the pressure angle, the lower the risk of slippage of a strip of rolled material or of passing problems. In addition, with a roll diameter and a correlating drive journal diameter, the transferable torque also increases. By selectively changing the work rolls and thus changing the roll diameter range, the hot-rolling stand can thus be adjusted to the production parameters to be represented, such as the product to be manufactured, a respective process control, respective dimensions, respective materials and/or respective quality requirements, without having to compromise on the selection of a roll diameter of the work rolls.

The hot-rolling stand is designed such that the work rolls of the pair of work rolls can be mounted interchangeably and correspondingly to one another with different roll diameter ranges. Preferably, at least two different roll diameter ranges can be realized for the individual work roll of the pair of work rolls. In accordance with the invention, the work rolls of the pair of work rolls are always mounted with corresponding roll diameter ranges; that is, the currently mounted work rolls always have the same roll diameter range.

In the hot-rolling stand, the work rolls are preferably replaced laterally and substantially perpendicularly, particularly preferably perpendicularly, to the longitudinal extension of a throughput section.

A "roll diameter range" refers to a diameter range of the individual work roll that is characterized by a nominal roll diameter and a grinding range. The grinding range defines a permissible diameter reduction of the respective roll over its operating time. The selectable roll diameter ranges differ from each other in that the diameter deviation (significantly) exceeds the usual roll grinding.

According to one embodiment, the hot-rolling stand is designed as a roughing stand. In such a case, the hot-rolling stand is therefore designed to be used within a hot-rolling mill as a roughing stand for the entry-side rolling of the rolled material in the hot-rolling mill. In accordance with an alternative design option, the hot-rolling stand is designed as a finishing stand that is used within a hot-rolling mill, in particular for the stepped forming of the rolled material to a predetermined dimension.

In a further development, a deviation between the different roll diameter ranges amounts to ≥6%, preferably ≥10%. A deviation between the roll diameter ranges that can be represented by replacement is thus at least 6% between a small roll diameter range and a large roll diameter range, but preferably at least 10%. This has the advantage that, with a deviation in such order of magnitude, the different requirements and also different correlations between rolling parameters and rolling diameter can be taken into account through a change.

In accordance with a further embodiment, the adjusting device comprises as components a wedge adjusting device of a lower work roll of the pair of work rolls and/or a hydraulic positioning device of an upper work roll of the pair of work rolls and/or in each case a work roll bending device of the lower and/or the upper work roll, wherein the components of the adjusting device in each case have a range of adjustment to interchangeably accommodate the mutually complementary work rolls with different roll diameter ranges. This makes it possible to accommodate work rolls with different roll diameter ranges in the hot-rolling stand, since the components can individually or collectively represent the strokes required for this purpose.

It is a further design option that the hot-rolling stand is designed for reversing operation or one-way operation. In such a case, design for reversing operation means that the rolled material is fed through the hot-rolling stand several times and in a reversing manner, that is, with opposite conveying directions to one another, whereas in one-way operation the rolled material is fed through the hot-rolling stand only in one direction and only one time.

In a further development of the invention, a pass line variation when using the different roll diameter ranges amounts to less than +/−20 mm, preferably +/−15 mm, more preferably +/−10 mm. Thereby, the "pass line" is to be understood as a difference in height between the lower work roll of the pair of work rolls and an adjacent roll of a roll table, wherein the fluctuation of the pass line should be as low as possible, as otherwise difficulties could arise when threading the rolled material between the work rolls, or a collision of the rolled material with the lower work roll could arise.

It is also an object of the disclosure to provide a hot-rolling mill comprising at least one hot-rolling stand designed according to one or more of the aforementioned variants. Preferably, the hot-rolling mill is composed of a plurality of units, which may include a pre-heating unit, a roughing rolling train, an intermediate heating unit, a finishing rolling train, a transport unit, a rewinding unit and/or various separating units. In addition, the hot-rolling mill can have other units, such as scale washers, possible induction heating equipment, and the like.

According to a preferred embodiment, a hot-rolling mill is provided with a roughing rolling train having at least one roughing stand and a finishing rolling train having at least one finishing stand, wherein at least one roughing stand of the roughing rolling train and/or at least one finishing stand of the finishing rolling train each is designed as a hot-rolling stand according to one or more of the aforementioned variants. Particularly preferably, both with at least one roughing stand of the roughing rolling train and in at least one finishing stand of the finishing rolling train, work rolls of the respective pair of work rolls can be changed in pairs while changing the roll diameter range.

The disclosure also relates to a method for operating a hot-rolling mill. Thereby, at least the following method steps are carried out:

a) Checking a production sequence to be represented for operating parameters;
b) Checking a currently selected roll diameter range of work rolls of a pair of work rolls of at least one hot-rolling stand designed according to one or more of the aforementioned variants;
c) Checking whether the currently selected roll diameter range matches the operating parameters of the production sequence to be represented,
   wherein, in the case to be answered in the negative, a change of work rolls in pairs of the pair of work rolls with a change of the roll diameter of the work rolls is carried out at the at least one hot-rolling stand and/or a change of the production sequence to be represented is carried out, and wherein subsequently the check is initiated again starting on step a), while in the case to be affirmed the rolling operation is carried out without any change.

In other words, the method initially records operating parameters of a production sequence to be represented by the hot-rolling mill. The operating parameters define the process steps required to produce a target product from a starting product and process parameters of the hot-rolling mill and the rolled material during the process steps. Such operating parameters preferably include the parameters of pass reduction and operating mode. Moreover, with at least one hot-rolling stand designed according to one or more of the aforementioned variants, a current roll diameter range of work rolls of a pair of work rolls of such hot-rolling stand is determined. Subsequently, there is a check of whether the desired operating parameters can be realized with the current roll diameter range of the at least one hot-rolling stand. If this is the case, a rolling operation is carried out without undertaking a change. If, on the other hand, it is determined that the current roll diameter range of the work rolls of the pair of work rolls and the operating parameters of the production sequence to be represented do not match, the work rolls of the pair of work rolls are changed in pairs while changing the roll diameter range, and/or the operating parameters of the production sequence are changed in order to match the operating parameters and the roll diameter range of the work rolls of the at least one hot-rolling stand. The check procedure is subsequently repeated until the production sequence matches the operating parameters in conjunction with the determined work roll diameter range, and subsequently the rolling operation is initiated.

This has the advantage that the hot-rolling mill can be used for a wide range of production without having to compromise with respect to operating parameters. Specifically, if it is determined that the desired operating parameters cannot be achieved or cannot be achieved optimally with the currently mounted work rolls, then as an alternative or in addition to changing the operating parameters, the roll diameter range of the pair of work rolls in the at least one hot-rolling stand can also be changed in order to achieve the parameters even better. Overall, this allows the flexible use of the hot-rolling mill while at the same time reliably achieving the desired operating parameters.

According to one embodiment, when the work rolls are changed in pairs, a change is made to a smaller roll diameter range if a pass reduction of ≥40%, more preferably ≥50%, ≥60% or most preferably ≥70% is detected in the hot-rolling mill. Pass reductions of this order of magnitude using work rolls with a smaller roll diameter range have the advantage of reducing the system load, the heat flow from the rolled material into the respective roll and also the energy consumption due to the reduced forming work. A "pass reduction" is understood to mean the thickness ratio of the rolled material entering the roll gap to the rolled material leaving the roll gap.

In a further development of the aforementioned embodiment, a further reason for changing to a smaller roll diameter range may be that a number of passes of the single work roll is smaller than a number of fully wound coils. This indicates endless or semi-endless operation of the hot-rolling mill, with each of which the use of work rolls with a small roll diameter range is advantageous. The same is preferably also carried out if a rolled material to be rolled is rolled endlessly and, accordingly, de facto endless operation of the hot-rolling mill takes place.

As a further alternative, when the work rolls are changed in pairs, a change is made to a smaller roll diameter range if there are no breaks in operation in rolling steps for the production of individual, fully wound coils.

It is a further design option that, when the work rolls are changed in pairs, a change is made to a larger rolling diameter range if one pass of a roll stand is made for each fully wound coil. One pass of a roll stand per fully wound coil means a single operation or batch operation of the hot-rolling mill, with which the use of work rolls with a larger roll diameter range is advantageous due to the greater thicknesses of the rolled material. By using the larger roll diameter range, the pressure angle can be kept small, thus avoiding slippage of the rolled material.

In accordance with one embodiment, the method steps are guided by a system configurator. Thus, a higher-level control unit is provided, which carries out the method steps and can accordingly initiate and coordinate the change of a roll diameter range of the work rolls at the at least one hot-rolling stand and/or a change of the production sequence to be represented if the corresponding prerequisites are met.

In a further development of the aforementioned embodiment, a calculation is carried out by the system configurator taking into account geometric limits based on support rolls currently located in the individual roll stand. The background here is that, with a roll stand, the support rolls currently located in the roll in conjunction with the work rolls currently located in the roll stand define the geometric conditions and thus, if necessary, stroke limitations of the adjusting device are taken into account. For example, in the region of the ground support roll located in the stand, the change of the work rolls to another roll diameter range without a simultaneous change of the support rolls may be impossible due to the change of the stroke range. However, since a change of the support rolls is significantly more expensive than a change of the work rolls, a necessary change of the support rolls of a hot-rolling stand and the associated expense can already compensate for the benefit of a change of the roll diameter range of the work rolls.

Alternatively or in addition to the aforementioned further development, a calculation is carried out by the system configurator taking into account process parameters such as gripping conditions, rolling speed, roll rotational speed, drive rotational speed, drive torque.

It is possible to combine individual features that are apparent from the claims, the following description of a preferred embodiment or directly from the drawings. The reference of the claims to the drawings by the use of reference signs is not intended to limit the scope of protection of the claims.

BRIEF DESCRIPTION OF THE DRAWINGS

An advantageous embodiment of the invention, which is explained below, is shown in the drawings.

DETAILED DESCRIPTION

Figure 1:
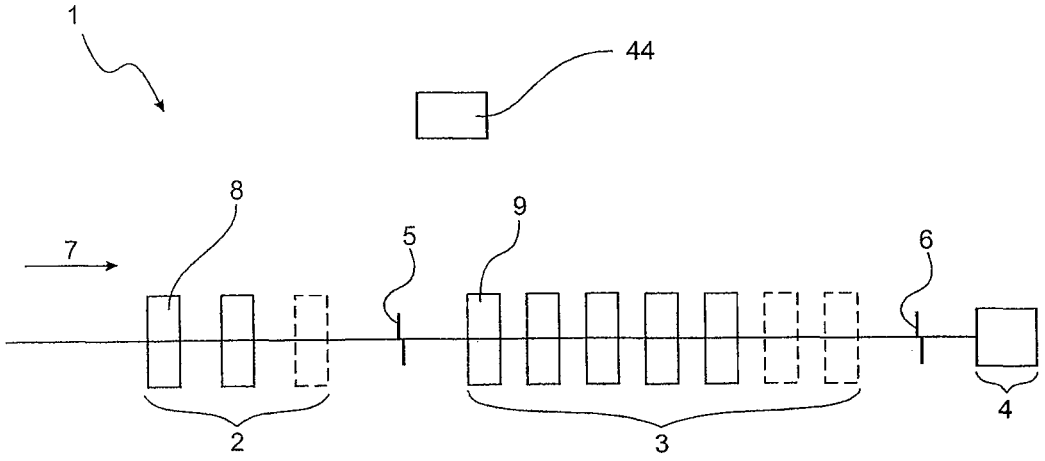
FIG. 1 shows a schematic view of a hot-rolling mill.

FIG. 1 shows a schematic view of a hot-rolling mill 1 designed in accordance with a preferred embodiment. In a production plant, this hot-rolling mill 1 can be connected in particular to an upstream continuous casting plant—which is not shown further here—and comprises a roughing rolling train 2, a finishing rolling train 3, a coiler 4 and shears 5 and 6.

In a main transport direction 7 of the hot-rolling mill 1, the entry-side roughing rolling train 2, which is composed of several roughing stands 8 arranged one behind the other, is initially followed by the shear 5, which is arranged between the roughing rolling train 2 and the finishing rolling train 3 in the main transport direction 7. The finishing rolling train has a plurality of finishing stands 9 arranged one behind the other, which are followed within the hot-rolling mill 1 in the main transport direction 7 initially by the shear 6 and at the end by the coiler 4. For reasons of simplification, no further known components, such as scale washers, heating devices, cooling devices, etc., are shown.

Figure 2:
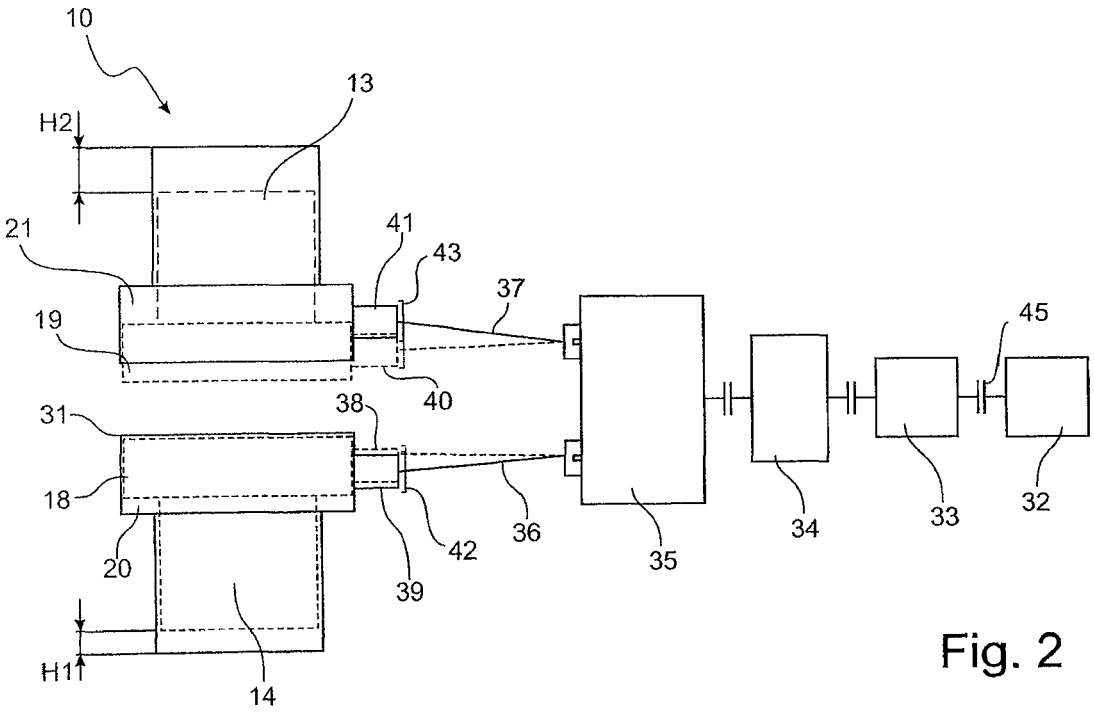
FIG. 2 shows a schematic illustration of a hot-rolling stand of the hot-rolling mill of FIG. 1.
Figure 3:
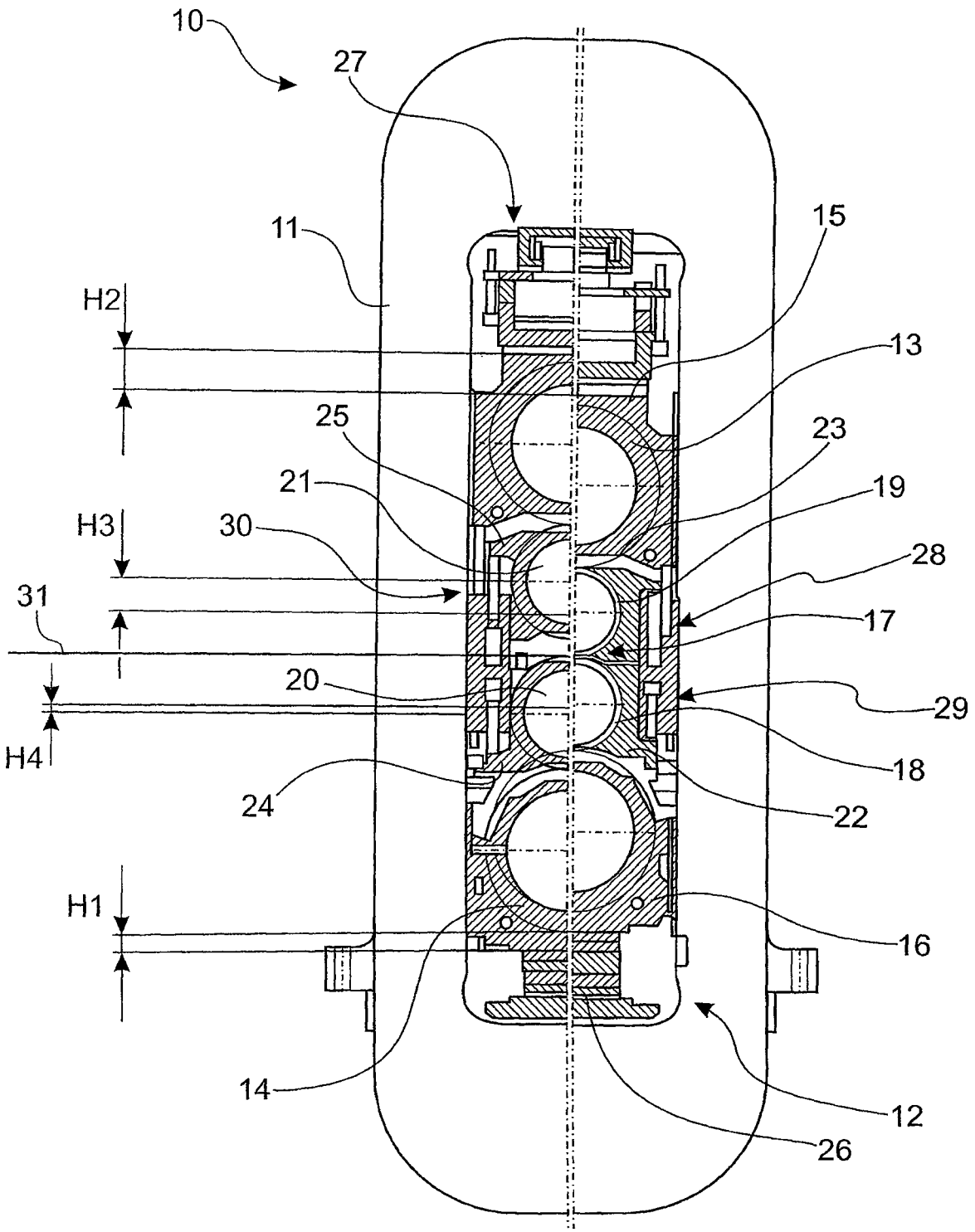
FIG. 3 is a sectional view of the hot-rolling stand of FIG. 2.

FIGS. 2 and 3 show views of a hot-rolling stand 10, which can specifically be one of the roughing stands 8 of the roughing rolling train 2 or one of the finishing stands 9 of the finishing rolling train 3. Thereby, the hot-rolling stand 10 is designed as a quarto roll stand and comprises two roll stands 11, of which only one is visible in this view, an adjusting device 12, a pair of support rolls and a pair of work rolls 17. Thereby, the pair of support rolls consists of an upper support roll 13 and a lower support roll 14, each of which is rotatably accommodated in an associated chock 15 or 16. Thereby, the support rolls 13 and 14 of the pair of support rolls support the pair of work rolls 17, which is used to form the rolled material fed to the hot-rolling stand 10.

As a special feature, work rolls 18 and 19 along with 20 and 21 with different roll diameter ranges can be accommodated in the hot-rolling stand 10, wherein, in FIG. 3, the left half shows an accommodation of work rolls 18 and 19 with a large roll diameter range and the right half shows an accommodation of work rolls 20 and 21 with a small roll diameter range. Each of the currently mounted work rolls 18 and 19 or 20 and 21, as the case may be, of the pair of work rolls thereby always has the same roll diameter range, wherein the work rolls 18 and 19 or 20 and 21 are changed in pairs when the roll diameter range is changed. Thereby, a deviation between the small roll diameter range and the large roll diameter range is ≥6%, preferably ≥10%. Thereby, the individual work rolls 18 or 19 or 20 or 21 are each rotatably guided in a corresponding chock 22 or 23 or 24 or 25, as the case may be.

Due to the different roll diameter ranges, there are also different strokes H1, H2, H3, H4, which are to be represented via the adjusting device 12 in order to position the work rolls 18 and 19 or 20 and 21 of the pair of work rolls while forming a required roll gap, that is, a distance between the respective work rolls 18 and 19 or 20 and 21, as the case may be. In order to adjust the respective stroke for realizing the respectively required roll gap, the adjusting device 12 comprises as components, in addition to the roll stands 11, a wedge adjusting device 26 of the lower support roll 14 and the lower work roll 18 or 20, a hydraulic positioning device 27 of the upper support roll 13 and the upper work roll 19 or 21 along with a work roll bending device 28 or 29 of each of the upper work roll 19 or 21 and the lower work roll 18 or 20, as the case may be. Thereby, the wedge adjusting device 26, the hydraulic positioning device 27 and the work roll bending devices 28 and 29 each have a range of adjustment in order to be able to realize the different strokes for representing the interchangeable accommodation of the work rolls 18 and 19 or 20 and 21 with the different roll diameter ranges. In addition, a roll balancer 30 is assigned to the upper support roll 13.

In the illustration of FIG. 3, with the small work roll diameter range used with the work rolls 18 and 19, an extension of the adjustable strokes of the adjusting device 12 is visible via assigned spacers, which can be part of the hydraulic positioning device 27, or the wedge adjusting device 26. The necessary strokes can thus be adjusted directly via the travel of the wedge adjusting device 26 and/or the hydraulic positioning device 27, or alternatively in combination with spacers that simplify the design of the adjusting device.

Via the adjusting device 12, the respective lower work roll 18 or 20 is to be adjusted with its upper edge at the height of a desired pass line 31 indicated in FIG. 2, while the respective upper work roll 19 or 21 is aligned with the lower work roll 18 or 20 to define the desired roll gap. If necessary, the roll gap is initially thereby selected to be larger for threading the rolled material and is subsequently reduced.

FIG. 2 also shows a drive of the respectively mounted work rolls 18 and 19 or 20 and 21 wherein, in the view in FIG. 2, the work rolls 18 and 19 with the small roll diameter region are indicated by dashed lines. Two drive motors 32 and 33, connected in tandem, are provided to drive the respective mounted work rolls 18 and 19 or 20 and 21 of the pair of work rolls. A shift coupling 45 can be provided between the drive motors 32, 33. The drive motors 32 and 33 are connected on the output side to a transmission gearbox 34, which may be in the form of a manual gearbox, which transmits a drive movement of the drive motors under a gear transmission ratio to a pinion gearbox 35, via which the transmitted drive movement is transferred by means of spindles 36 and 37 in each case to the associated mounted work roll 18 or 19 or 20 or 21. For the transfer of the drive movements, the work rolls 18 and 19 or 20 and 21 have coupling sleeves 38 or 39 or 40 or 41 which are accommodated by associated sleeves 42 and 43 of the spindles 36 and 37.

It is clear that the different roll diameters of the work rolls result not only in stroke movements H1, H2 of the hydraulic positioning device 27 and the wedge adjusting device 26, but also in stroke movements (H3, H4) of the coupling sleeves 38, 39, 40, 41 and the work roll chocks 22, 23, 24, 25, which must be compensated for by the work roll bending devices 28, 29. The spindles 36, 37 used for both roll diameter ranges must be designed for a deflection resulting from the strokes.

The hot-rolling mill 1 shown in FIG. 1 is used to produce semi-finished products in the form of strips, wherein, depending on the requirements of the strip to be produced, this can be done in a single or batch operation, with which the rolled material arrives at the hot-rolling mill 1 in predetermined length sections corresponding to a finished coil and is threaded into the individual roll stand through a roll gap preset to the target thickness of the strip.

On the other hand, production can also take place in an endless operation, with which the rolled material is fed through the individual roll stands as an endless strip. During initial threading, the roll gap of each participating roll stand is set to the target thickness, wherein the first target thickness is selected to be so large that the pass can be made without any complications in terms of process technology. To adjust thinner strip lengths of the endless strip, a transition piece is manufactured, which piece has a wedge-shaped thickness progression over its strip length. For finishing, the rolled material/strip is only separated once by the shear 6 and wound into individual coils via the coiler 4.

Figure 4:
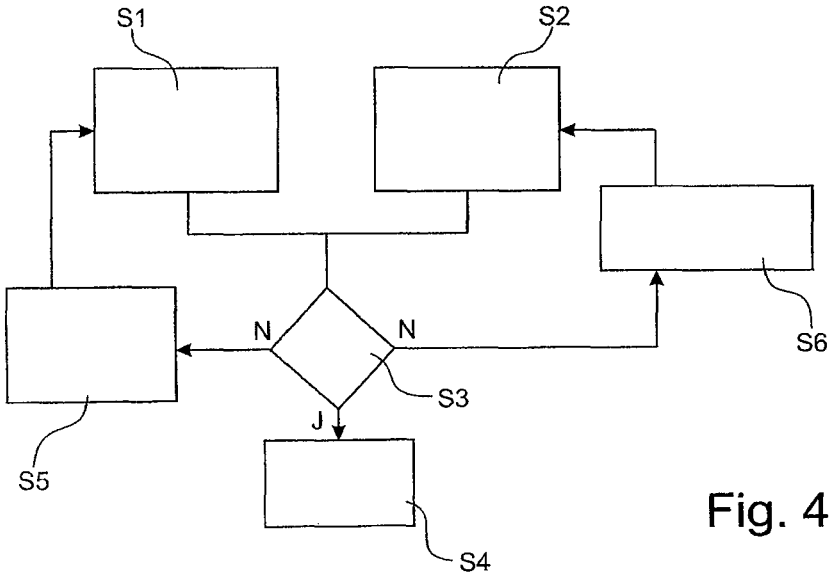
FIG. 4 is a flow chart of a method for operating the hot-rolling mill of FIG. 1.

For the design of the manufacturing process, the hot-rolling mill 1 has a system configurator 44, which is schematically indicated in FIG. 1. Among other things, this system configurator 44 is thereby capable, during the operation of the hot-rolling mill 1, of carrying out the operation of the hot-rolling mill 1 according to a method in accordance with the invention, the sequence of which is indicated in the flow diagram in FIG. 4.

Thereby, in a step S1, operating parameters of the production sequence currently to be represented are determined, wherein such operating parameters preferably comprise the parameters of pass reduction and operating mode. Upstream, downstream or parallel thereto, which roll diameter range of work rolls 18 and 19 or 20 and 21 of the pair of work rolls 17 of a hot-rolling stand 10 is currently implemented is also determined in a step S2, wherein, with such hot-rolling stand 10, as described above, it is possible to replace the work rolls 18 and 19 or 20 and 21 in pairs with work rolls with a different roll diameter range. Thereby, with the hot-rolling mill 1, one or more of the roughing stands 8 and/or one or more of the finishing stands 9 can be designed in this manner with interchangeable work rolls.

In a step S3, the system configurator 44 then checks whether the operating parameters recorded in step S1 match the respective roll diameter range of the individual hot-rolling stand 10 determined in step S2. If this is to be affirmed, a rolling operation is carried out in a step S4 without any change.

If, on the other hand, the result from step S3 is negative, the process proceeds to step S5 and/or step S6. Thereby, in step S5, a change is made to the production sequence and thus to the desired operating parameters, while in step S6, the system configurator 44 brings about a modification in the roll diameter range by changing the work rolls in pairs. Thereby, the goal of the system configurator 44 is to match the operating parameters and the respective roll diameter range.

Thereby, in step S6, the system configurator 44 takes into account geometric limits due to the support rolls 13 and 14 currently located in the individual hot-rolling stand 10, since only a corresponding stroke range can be represented via the support rolls 13 and 14 of the respective hot-rolling stand 10, and an additional replacement of the support rolls 13 and 14 is very costly. In addition, the system configurator 44 takes into account process parameters such as gripping conditions, rolling speed, roll rotational speed, drive rotational speed, and the like.

The function of the invention is described using the example of a three-stand roughing rolling train 2 with a roll diameter range 18, 19 of 850 mm and a roll diameter range 20, 21 of 1050 mm, respectively, which can be used in the hot-rolling mill 1 with the two operating modes of batch and endless. The permissible grinding range of both roll diameter ranges amounts to 100 mm. The rolled material in each case is a simple carbon steel.

As a rule, the system configurator 44 assigns various general parameters to the operating modes:

| Operating mode | Strip thickness Input Roughing stand | Strip speed | Finished strip thickness |
|---|---|---|---|
| Endless | Small | Low | Small |
| Batch | Large | High | Medium to large |

Rolled material: carbon steel, "batch" operating mode

| Work roll diameter: 1050 mm | Input thickness [mm] | Output thickness [mm] | Strip speed [m/s] | Roll rotational speed [rpm] | Roll torque [kNm] | Forming temperature [° C.] |
|---|---|---|---|---|---|---|
| Stand 1 | 150 | 108 | 0.29 | 5.3 | 3950 | 1100 |
| Stand 2 | 108 | 75 | 0.6 | 10.9 | 3230 | 1080 |
| Stand 3 | 75 | 45 | 1.0 | 18.2 | 3680 | 1060 |

The absolute pass reduction amounts to 70%.

In this exemplary embodiment, it is clear that the mass flow (strip thickness times strip speed) and rolling moment are relatively high. The forming temperatures change only slightly due to the high strip speed. The system configurator 44 checks the operating parameters (initial thickness, strip speed, roll rotational speed, roll torque and forming temperature) that result from the intended operating mode of "batch" with the work roll diameter of 1050 mm used on the basis of the calculation model created by itself or by a connected calculation model and comes to the conclusion that the intended operating parameters and the roll diameter range used are suitable and that the rolling operation can be carried out under the planned conditions.

Rolled material: carbon steel, "endless" operating mode

| Work roll diameter: 850 mm | Input thickness [mm] | Output thickness [mm] | Strip speed [m/s] | Roll rotational speed [rpm] | Roll torque [kNm] | Forming temperature [° C.] |
|---|---|---|---|---|---|---|
| Stand 1 | 100 | 53 | 0.19 | 4.3 | 2400 | 1100 |
| Stand 2 | 53 | 25 | 0.4 | 9.0 | 1780 | 1000 |
| Stand 3 | 25 | 12 | 0.8 | 18.0 | 1115 | 941 |

The absolute pass reduction amounts to 88%.

In this exemplary embodiment, it is clear that the mass flow and rolling moment are relatively low, specifically 22% of the comparative value for the batch mode. As a result, the strip temperature changes significantly more, by an amount of 159° C. The system configurator 44 checks the operating parameters (initial thickness, strip speed, roll rotational speed, rolling torque and forming temperature) that result from the intended operating mode of "endless" with the work roll diameter of 850 mm used on the basis of the calculation model created by itself or by a connected calculation model and comes to the conclusion that the intended operating parameters and the roll diameter range used are suitable and that the rolling operation can be carried out under the planned conditions. Depending on the design case, it can be suggested by the system configurator 44 to roll with a modified shift stage of the transmission gearbox 34 or with only one drive motor 33 in order to realize the lower speeds and torques with optimum utilization of the motor.

If, in the same exemplary embodiment, a ○ 1050 mm roll were used in the first pass, the comparable rotational speed would be 3.45 and would put a strain on the motor design. At the same time, the heat transfer would cause the forming temperature to drop even further, such that in unfavorable cases undesirable microstructural changes could occur. The system configurator 44 would come to the conclusion that either the intended rolling program is to be adjusted or a smaller roll diameter range is to be used to improve the unfavorable operating conditions.

The two sample calculations shown are designed for a standard product. Due to the variance with regard to the alloy, temperature range, rolled material width and input and output thickness, there are significantly larger spreads that must be taken into account by the design and calculations of the system configurator.

By means of the hot-rolling stand design in accordance with the disclosure, a hot-rolling mill, which can be flexibly adjusted to different finished products, process designs, dimensions, materials and/or quality requirements, can be realized.

LIST OF REFERENCE SIGNS

1 Hot-rolling mill
2 Roughing rolling train
3 Finishing rolling train
4 Coiler
5 Shear
6 Shear
7 Main transport direction
8 Roughing stand
9 Finishing roll stand
10 Hot-rolling stand
11 Roll stands
12 Adjusting device
13 Upper support roll
14 Lower support roll
15 Chock
16 Chock
17 Pair of work rolls
18 Lower work roll
19 Upper work roll
20 Lower work roll
21 Upper work roll
22 Chock
23 Chock
24 Chock
25 Chock
26 Wedge adjusting device
27 Hydraulic positioning device
28 Work roll bending device
29 Work roll bending device
30 Roller balancer
31 Pass line
32 Drive motor
33 Drive motor
34 Transmission gearbox
35 Comb roller gearbox
36 Spindle
37 Spindle
38 Coupling sleeve
39 Coupling sleeve
40 Coupling sleeve
41 Coupling sleeve
42 Sleeve
43 Sleeve
44 System configurator
45 Shift coupling
H1 Stroke of wedge adjusting device
H2 Stroke of hydraulic positioning device
H3 Stroke of upper work roll bending device/coupling sleeve
H4 Stroke of lower work roll bending device/coupling sleeve
S1 to S6 Individual steps

The invention claimed is:

1. A hot-rolling stand (10) for a hot-rolling mill (1) and for producing a flat metal product, comprising:
- a pair of work rolls (17), including
  - an upper work roll (19; 21) having an upper coupling sleeve (40; 41), and
  - a lower work roll (18; 20) having a lower coupling sleeve (38; 39);
- an adjusting device (12) for accommodating the pair of work rolls (17) and for positioning the upper work roll (19; 21) and the lower work roll (18, 20) of the pair of work rolls (17) in relation to one another to define a roll gap;
- a drive motor (33);
- a pinion gearbox (35) having an input connected to the drive motor (33);
- an upper spindle (37) connecting an upper output of the pinion gearbox (35) to the upper work roll (19; 21), the upper spindle (37) having an upper spindle sleeve (43) that accommodates the upper coupling sleeve (40; 41);
- a lower spindle (36) connecting a lower output of the pinion gearbox (35) to the lower work roll (18; 20), the lower spindle (36) having a lower spindle sleeve (42) that accommodates the lower coupling sleeve (38; 39),
- wherein the adjusting device (12) is designed to interchangeably accommodate, in the pair of work rolls (17), different roll diameter ranges of mutually complementary work rolls (18, 19; 20, 21),
- wherein the upper spindle (37) and the lower spindle (36) are designed to support a deflection that results from the different roll diameter ranges of the mutually complementary work rolls (18, 19; 20, 21),
- wherein a deviation between the different roll diameter ranges amounts to ≥6%, and
- wherein a pass line variation when using the different roll diameter ranges amounts to less than +/−20 mm.

2. The hot-rolling stand (10) according to claim 1, wherein the hot-rolling stand (10) is a roughing stand.

3. The hot-rolling stand (10) according to claim 1, wherein the hot-rolling stand (10) is a finishing stand.

4. The hot-rolling stand (10) according claim 1,
- wherein the deviation between the different roll diameter ranges amounts to ≥10%.

5. The hot-rolling stand (10) according to claim 1,
- wherein the adjusting device (12) comprises as components:
  - a wedge adjusting device (26) of a lower work roll (18; 20) of the pair of work rolls (17), a hydraulic positioning device (27) of an upper work roll (19; 21) of the pair of work rolls (17), a work roll bending device (28, 29) of the lower work roll (18; 20), and a work roll bending device (28) of the upper work roll (19; 21), wherein the components of the adjusting device (12) each have a corresponding range of adjustment to interchangeably accommodate the different roll diameter ranges of the pair of work rolls (17) with the mutually corresponding work rolls (18, 19; 20, 21).

6. The hot-rolling stand (10) according to claim 1, wherein the hot-rolling stand (10) supports a reversing operation or a one-way operation.

7. The hot-rolling stand (10) according claim 1, wherein the pass line variation amounts to less than +/−10 mm.

8. A hot-rolling mill (1) comprising at least one hot-rolling stand (10) according to claim 1.

9. The hot-rolling mill (1) according to claim 8, wherein a roughing rolling train (2) with at least one roughing stand (8) and a finishing rolling train (3) with at least one finishing stand (9) are provided, wherein the at least one roughing stand (8) of the roughing rolling train (2) and/or the at least one finishing stand (9) of the finishing rolling train (3) each is designed as the hot-rolling stand (10) according to claim 1.

10. The hot-rolling stand (10) according to claim 1, further comprising a manual gearbox (34) operatively connected to an output of the drive motor (33) and the input of the pinion gearbox (35).

11. The hot-rolling stand (10) according to claim 1, further comprising a further drive motor (32), the further drive motor (32) being connected in tandem to the drive motor (33) by a shift coupling (45).

12. A method for operating a hot-rolling mill (1), comprising the following method steps:

a) determining operating parameters of a production sequence, the operating parameters including a pass reduction and an operating mode, the production sequence being defined by end products being produced that differ in one or more of a material, a target dimension, or a desired degree of deformation;

b) determining a currently selected roll diameter range of work rolls (18, 19; 20, 21) of a pair of work rolls (17) of at least one hot-rolling stand (10), the at least one hot-rolling stand (10) comprising an adjusting device (12) for accommodating a pair of work rolls (17) and for positioning work rolls (18, 19; 20, 21) of the pair of work rolls (17) in relation to one another to define a roll gap, wherein the adjusting device (12) is designed to interchangeably accommodate, in the pair of work rolls (17), different roll diameter ranges of mutually complementary work rolls (18, 19; 20, 21), wherein a deviation between the different roll diameter ranges amounts to ≥6%, and wherein a pass line variation when using the different roll diameter ranges amounts to less than +/−20 mm;

c) checking whether the currently selected roll diameter range matches the operating parameters of the production sequence, wherein, if the currently selected roll diameter range does not match the operating parameters of the production sequence, a change of work rolls (18, 19; 20, 21) in pairs of the pair of work rolls (17) with a change of the roll diameter range of the work rolls (18, 19; 20, 21) is carried out at the at least one hot-rolling stand (10) and/or a change of the production sequence is carried out, and wherein subsequently the method is initiated again with step a), and wherein, if the currently selected roll diameter range does match the operating parameters of the production sequence, the rolling operation is carried out without any change.

13. The method according to claim 12, wherein, when the work rolls (18, 19; 20, 21) are changed in pairs, a change is made to a smaller than the currently selected roll diameter range if a pass reduction of ≥40% is detected in the hot-rolling mill (1).

14. The method according to claim 12, wherein, when the work rolls (18, 19; 20, 21) are changed in pairs, a change is made to a smaller than the currently selected roll diameter range if the operating mode is an endless mode.

15. The method according to claim 12, wherein, when the work rolls (18, 19; 20, 21) are changed in pairs, a change is made to a larger than the currently selected roll diameter range if the operating mode is a batch mode.

16. The method according to claim 12, wherein the method steps are performed by a system configurator (44).

* * * * *